US007374658B2

(12) United States Patent
Rosenbaum et al.

(10) Patent No.: US 7,374,658 B2
(45) Date of Patent: May 20, 2008

(54) MEDIUM SPEED DIESEL ENGINE OIL

(75) Inventors: John M. Rosenbaum, Richmond, CA (US); Nancy K. Smrcka, Richmond, CA (US)

(73) Assignee: Chevron Corporation, San Ramon, CA (US)

( * ) Notice: Subject to any disclaimer, the term of this patent is extended or adjusted under 35 U.S.C. 154(b) by 443 days.

(21) Appl. No.: 11/118,838

(22) Filed: Apr. 29, 2005

(65) Prior Publication Data

US 2006/0247138 A1 Nov. 2, 2006

(51) Int. Cl.
*C10G 71/00* (2006.01)

(52) U.S. Cl. ..... 208/18

(58) Field of Classification Search ..... 208/18, 208/19

See application file for complete search history.

(56) References Cited

U.S. PATENT DOCUMENTS 3,852,207 A 12/1974 Stangeland et al.
4,673,487 A 6/1987 Miller
5,135,638 A 8/1992 Miller
5,282,958 A 2/1994 Santilli et al.
6,027,636 A * 2/2000 Poirier ..... 208/213
6,103,099 A * 8/2000 Wittenbrink et al. ..... 208/27
6,503,956 B2 1/2003 Maleksadeh
6,703,353 B1 * 3/2004 Lok et al. ..... 508/110
6,713,438 B1 * 3/2004 Baillargeon et al. ..... 508/463
6,833,065 B2 * 12/2004 O'Rear ..... 208/19

* cited by examiner

*Primary Examiner*—Walter D. Griffin
*Assistant Examiner*—Francis C Campanell
(74) *Attorney, Agent, or Firm*—Susan M. Abernathy

(57) ABSTRACT

A lubricating oil having a CCS viscosity at −15° C. less than 7000 cP, good shear stability, and a TBN between 8 and 20 comprising: a) a lubricating base oil made from a waxy feed, b) an engine oil additive package formulated to protect silver bearings, and c) less than 2.0 wt % viscosity index improver. Also a process to make a lubricating oil having a CCS viscosity at −15° C. less than 7000 cP, good shear stability, and a TBN between 8 and 20. Additionally, a lubricating oil having low CCS viscosity comprising specified amounts of lubricating base oil made from a waxy feed, engine oil additive package formulated to protect silver bearings, up to 55 wt % bright stock with a VI greater than 120, and no viscosity index improver or conventional pour point depressant additives. Also, a method for operating a railroad engine using the lubricating oil of this invention.

24 Claims, No Drawings

MEDIUM SPEED DIESEL ENGINE OIL

FIELD OF THE INVENTION

This invention is directed to a composition of lubricating oil, designed for use in medium-speed diesel engines, having excellent cold cranking simulator viscosity and shear stability; a process for making the lubricating oil; and a method for operating a railroad engine with the lubricating oil.

BACKGROUND

U.S. patent application Ser. No. 10/743932, filed Dec. 23, 2003, teaches a finished lubricant that has less than 8 weight percent VI improver comprising a lubricating base oil made from Fischer Tropsch wax having particularly desired aromatic and cycloparaffinic molecular composition and at least one lubricant additive U.S. Provisional Application 60/599665, filed Aug. 5, 2004, teaches a multigrade engine oil comprising: (a) a Fischer-Tropsch base oil characterized by a kinematic viscosity between about 2.5 and about 8 cSt at 100° C., and having a desired composition of cycloparaffin molecules; (b) a pour point depressing base oil blending component; and (c) an additive package designed to meet the specifications for ILSAC GF-3; and (d) no additional pour point depressant additive or viscosity index improver.

Current medium-speed diesel engine oils may be blended to SAE 40 or SAE 20W-40 using conventional Group I or Group II base oils and engine oil additive packages formulated to protect silver. All of these medium-speed diesel engine oils have cold cranking simulator viscosities greater than 7000 cP at −15° C. In order to meet SAE 15W-40 viscosity grade, they also require that at least 2 wt % viscosity index improver be used. Viscosity index improvers are subject to shearing, and also add expense to the finished formulation. What is desired is a medium-speed diesel engine oil made with a high quality lubricating base oil made from a waxy feed and very low amounts or no viscosity index improver, that has a cold cranking simulator viscosity at −15° C. less than 7000 cP and meets the GE HTHS (final) requirements for shear stability.

SUMMARY OF THE INVENTION

We have discovered a lubricating oil comprising: a) a lubricating base oil, made from a waxy feed; b) an engine oil additive package formulated to protect silver bearings; and c) less than 2.0 wt % viscosity index improver; wherein the lubricant oil has a cold cranking simulator viscosity at −15° C. less than 7000 cP, a GE HTHS (final) of at least 10.8 cP, and a TBN between 8 and 20.

Additionally we have discovered a lubricating oil comprising: a) between 5 and 88 wt % lubricating base oil made from a waxy feed, b) between 5 and 20 wt % engine oil additive package formulated to protect silver bearings, c) up to 55 wt % bright stock having a viscosity index greater than 120, and d) no viscosity index improver or conventional pour point depressant additives; wherein the lubricating oil has a cold cranking simulator viscosity at −15° C. less than 7000 cP.

We have also discovered a process to make a lubricating oil, comprising: a) selecting a lubricating base oil, made from a waxy feed, having less than 0.3 wt % aromatics, greater than 10 wt % molecules having cycloparaffinic functionality, and a ratio of molecules with monocycloparaffinic functionality to molecules with multicycloparaffinic functionality greater than 15; b) blending the lubricating base oil with an engine oil additive package formulated to protect silver bearings and less than 2.0 wt % viscosity index improver; wherein the lubricating oil has a cold cranking simulator viscosity at −15° C. less than 7000 cP, a GE HTHS (final) of at least 10.8 cP, and a TBN between 8 and 20.

We have also discovered a method for operating a railroad engine, comprising using a lubricating oil in the railroad engine, wherein the lubricating oil has less than 100 ppm zinc, a cold cranking simulator viscosity at −15° C. less than 7000 cP, a GE HTHS (final) of at least 10.8 cP, and a TBN between 8 and 20.

DETAILED DESCRIPTION

Medium speed diesel engines are diesel engines with speeds between 450 and 1,000 rpm. They tend to be used for electricity generation and in rail locomotives, marine tugs, pumps, and stationary power units. Engine builders, including General Electric (GE) and the Electromotive Division of General Motors (EMD) set specifications for medium-speed diesel engine oils used in their railroad engines. In the United States., the Locomotive Maintenance Officers Association Fuels and Lubricants Committee have established 'Generation' designations for railroad diesel engine oils. The highest quality oils are designated Generation 5 and must have a high dispersant level and a detergent level measured by TBN of 13 or greater. A summary of the different engine builder specifications for Generation 5 railroad engine oils is provided in the table below.

Railroad Engine Builder Generation 5 Railroad Engine Oil Specifications

| Engine Builder | SAE Grade | TBN (ASTM D 2896) | Sulfated Ash, Wt % Max | Zinc, by wt. Max | Zinc, by wt. Min | API Classification | Road Test Requirement |
|---|---|---|---|---|---|---|---|
| GE U.S. | 40 or 20W-40 | 13 to 20 | — | — | — | — | 3 locomotives, 100,000 miles |
| GE Canada (Alco 251 Engines) | 40 | 7 to 13 | — | — | — | CD | — |
| GM EMD | 40 or 20W-40 | 10 to 20 | — | 10 ppm | — | — | 3 locomotives, 1 year |
| MTU | 30 or 40 | — | 1.5 | — | 0.05% | SE/CD | Required |
| | 15W-40 | — | 1.8 | | 0.05% | SE/CD | Required |
| Sulzer | 40 | — | — | — | — | CD | Required |
| SEMT Pielstick | 40 | 10 min. | — | — | — | CD | Required |
| SACM | 40 | 10 min. | — | — | — | CD | Required |

GE requires that a specific set of tests, referred to as GE Package 1 tests be conducted on Generation 5 railroad engine oils. The GE Package 1 testing for Generation 5 railroad engine oils (also known as the B82-1 testing) consists of the following test matrix:

- Kinematic Viscosity at 100° C. on the fresh oil (ASTM D 445)
- Shear the fresh oil 20 passes using the Fuel Injector Shear Stability (FISST) apparatus (ASTM D 5275)
- Kinematic Viscosity at 100° C. on the sheared oil (ASTM D 445)
- High Temp. High Shear Viscosity at 100° C. using the Tapered Bearing Simulator (ASTM D 4683) on the sheared oil as indicated above. This test is referred to as the GE HTHS (final) in this disclosure. GE sets a minimum specification for the GE HTHS (final) of 10.8 cP for Generation 5 railroad engine oils.

Until January 2000 GE set an upper limit of 15 wt % on the amount of bright stock that could be included in the railroad engine oils. Since that time they have reduced the upper limit to 10 wt % bright stock. These upper limits were imposed due to problems caused by bright stock in railroad engine oils in the past. When these limitations were imposed, bright stocks generally had viscosity indexes less than 120 and were derived from conventional petroleum feeds.

The term "lubricating oil" in the context of this invention refers to a finished lubricant suitable for use in the equipment it is designed for. It contains a major fraction of one or more lubricating base oils and a lesser fraction of one or more additives. The term "Fischer-Tropsch derived" means that the product, fraction, or feed originates from or is produced at some stage by a Fischer-Tropsch process. The feedstock for the Fischer-Tropsch process may come from a wide variety of hydrocarbonaceous resources, including natural gas, coal, shale oil, petroleum, municipal waste, derivatives of these, and combinations thereof.

Bright stock is named for the SUS viscosity at 210 degrees F., having viscosities above 180 cSt at 40 degrees C., preferably above 250 cSt at 40 degrees C., and more preferably ranging from 500 to 1100 cSt at 40 degrees C. Conventional petroleum derived bright stock has a viscosity index of 120 or less. Some newer conventional petroleum derived bright stocks, such as bright stock derived from Daqing crude, have viscosity indexes greater than 120. Fischer-Tropsch derived bright stock has a kinematic viscosity between about 15 cSt and about 40 cSt at 100 degrees C. and a viscosity index greater than 120, preferably greater than 145.

SAE J300 June 2001 contains the current specifications for SAE viscosity grades. The medium-speed diesel engine oils of this invention may be monograde or multigrade. Examples of monograde oils of this invention are SAE 40, SAE 50, and SAE 60. Preferably they are one of SAE 15-XX, 20-XX, and 25-XX, where XX is selected from 40, 50, or 60. More preferably they are SAE 15W-40, or SAE 20W-40 viscosity grade; and most preferably they are SAE 20W-40 viscosity grade. In preferred embodiments they will meet the specifications for railroad engine builders, including Electro Motive and General Electric.

The medium-speed diesel engine oils of this invention may contain between 5 and 88 wt % of the lubricating base oil made from a waxy feed. In preferred embodiments the lubricating base oil made from a waxy feed has: less than 0.3 wt % aromatics, greater than 10 wt % molecules with cycloparaffin functionality, and a ratio of molecules with monocycloparaffin functionality to molecules with multicycloparaffinic functionality greater than 15. The medium-speed diesel engine oils contain an engine oil additive package formulated to protect silver bearings in an amount between 5 and 20 wt %, preferably in an amount between 10 and 17 wt %. The amount is set to provide a desired TBN by ASTM D 2896 between 8 and 20.

The medium-speed diesel engine oils of this invention also have very low amounts of viscosity index improver. This is due to the very high viscosity of the lubricating base oils made from a waxy feed. The amount of viscosity index improver is generally less than 2 wt % of the medium-speed diesel engine oil, and preferably there is none. The low amounts of viscosity index improver reduces the overall cost of the formulated product, improves the cold cranking simulator viscosity, and improves the shear stability of the medium-speed diesel engine oil.

Cold Cranking Simulator Viscosity:

The medium-speed diesel engine oils of this invention have a very low cold cranking simulator viscosity. Cold cranking simulator viscosity is a test used to measure the viscometric properties of lubricating base oils and engine oils under low temperature and high shear. The test method to determine cold cranking simulator viscosity is ASTM D 5293-02. Results are reported in centipoise, cP. Cold cranking simulator viscosity has been found to correlate with low temperature engine cranking. Specifications for maximum cold cranking simulator viscosity are defined for engine oils by SAE J300, revised in June 2001. The cold cranking simulated viscosity measured at −15° C. of the medium-speed diesel engine oils of this invention are low, generally less than 7000 cP, preferably less than 5000 cP.

GE HTHS (final):

The medium-speed diesel engine oils of this invention have excellent shear stability. High temperature high shear rate viscosity (HTHS) is a measure of a fluid's resistance to flow under conditions resembling highly-loaded journal bearings in fired internal combustion engines. The HTHS value directly correlates to the oil film thickness in a bearing. Shear stability of medium-speed diesel engine oils is determined by shearing the fresh oil 20 passes using the Fuel Injector Shear Stability (FISST) apparatus (ASTM D 5275), then measuring the HTHS (final) by ASTM D 4683 on the sheared oil. The medium-speed diesel engine oils of this invention have a GE HTHS (final) of at least 10.8 cP, preferably at least 11.2 cP.

TBN:

TBN refers to the total base number as measured by ASTM D 2896-03. It is a measure of the amount of basic constituents that are present as additives in the oil. The TBN is determine by titration with acids, and reported in units of mg KOH/g. Railroad engine builders often specify the TBN of the engine oil to be used in their equipment. The TBNs of the medium-speed diesel engine oils of this invention are generally between 8 and 20 mg KOH/g, preferably between 10 and 20 mg KOH/g, and more preferably greater than or equal to 13 mg KOH/g.

Lubricating Base Oil Made from a Waxy Feed:

The lubricating base oils used in the medium-speed diesel engine oil of this invention are made from a waxy feed. The waxy feed useful in the practice of this invention will generally comprise at least 40 weight percent n-paraffins, preferably greater than 50 weight percent n-paraffins, and more preferably greater than 75 weight percent n-paraffins. The weight percent n-paraffins is typically determined by gas chromatography, such as described in detail in U.S.

patent application Ser. No. 10/897906, filed Jul. 22, 2004, incorporated by reference. The waxy feed may be a conventional petroleum derived feed, such as, for example, slack wax, or it may be derived from a synthetic feed, such as, for example, a feed prepared from a Fischer-Tropsch synthesis. A major portion of the feed should boil above 650 degrees F. Preferably, at least 80 weight percent of the feed will boil above 650 degrees F., and most preferably at least 90 weight percent will boil above 650 degrees F. Highly paraffinic feeds used in carrying out the invention typically will have an initial pour point above 0 degrees C., more usually above 10 degrees C.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes posses a very high viscosity index, normally in the range of from about 140 to 200, depending on the oil content and the starting material from which the slack wax was prepared. Therefore, slack waxes are suitable for the preparation of lubricating base oils having a very high viscosity index.

The waxy feed useful in this invention preferably has less than 25 ppm total combined nitrogen and sulfur. Nitrogen is measured by melting the waxy feed prior to oxidative combustion and chemiluminescence detection by ASTM D 4629-96. The test method is further described in U.S. Pat. No. 6,503,956, incorporated herein. Sulfur is measured by melting the waxy feed prior to ultraviolet fluorescence by ASTM D 5453-00. The test method is further described in U.S. Pat. No. 6,503,956, incorporated herein.

Waxy feeds useful in this invention are expected to be plentiful and relatively cost competitive in the near future as large-scale Fischer-Tropsch synthesis processes come into production. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into lubricating base oil. Accordingly, Fischer-Tropsch wax represents an excellent feed for preparing high quality lubricating base oils according to the process of the invention. Fischer-Tropsch wax is normally solid at room temperature and, consequently, displays poor low temperature properties, such as pour point and cloud point. However, following hydroisomerization of the wax, Fischer-Tropsch derived lubricating base oils having excellent low temperature properties may be prepared. A general description of suitable hydroisomerization dewaxing processes may be found in U.S. Pat. Nos. 5,135,638 and 5,282,958; and U.S. patent application Ser. No. 10/744870 filed December 23, incorporated herein.

The hydroisomerization is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof. SAPO-11, SM-3, SSZ-32, ZSM-23, and combinations thereof are more preferred. Preferably the noble metal hydrogenation component is platinum, palladium, or combinations thereof.

The hydroisomerizing conditions depend on the waxy feed used, the hydroisomerization catalyst used, whether or not the catalyst is sulfided, the desired yield, and the desired properties of the lubricating base oil. Preferred hydroisomerizing conditions useful in the current invention include temperatures of 260 degrees C. to about 413 degrees C. (500 to about 775 degrees F.), a total pressure of 15 to 3000 psig, and a hydrogen to feed ratio from about 0.5 to 30 MSCF/bbl, preferably from about 1 to about 10 MSCF/bbl. Generally, hydrogen will be separated from the product and recycled to the isomerization zone.

The hydroisomerization conditions are preferably tailored to produce one or more fractions having greater than 5 weight percent molecules with monocycloparaffinic functionality, more preferably having greater than 10 weight percent molecules with monocycloparaffinic functionality. The fractions will typically have a viscosity index greater than 140 and a pour point less than zero degrees C. Preferably the pour point will be less than −10 degrees C.

Optionally, the lubricating base oil produced by hydroisomerization dewaxing may be hydrofinished. The hydrofinishing may occur in one or more steps, either before or after fractionating of the lubricating base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487, incorporated herein. The hydrofinishing step may be needed to reduce the weight percent olefins in the lubricating base oil to less than 10, preferably less than 5, more preferably less than 1, and most preferably less than 0.5. The hydrofinishing step may also be needed to reduce the weight percent aromatics to less than 0.3, preferably less than 0.06, more preferably less than 0.02, and most preferably less than 0.01.

In a preferred embodiment the hydroisomerizing and hydrofinishing conditions in the process of this invention are tailored to produce one or more selected fractions of lubricating base oil having less than 0.3 weight percent aromatics, greater than 10 weight percent molecules with cycloparaffinic functionality, and a ratio of molecules with monocycloparaffinic functionality to molecules with multicycloparaffinic functionality greater than 15.

In one embodiment, the lubricating base oil made from a waxy feed useful in this invention have a very high viscosity index, typically greater than 140, but they may also have an even higher viscosity index, greater than an amount calculated by the equation: Viscosity Index=28×Ln(Kinematic Viscosity at 100° C., in cSt)+95; wherein Ln refers to the natural logarithm to the base 'e'. Viscosity index is determined by ASTM D 2270-93(1998).

The lubricating base oil fractions have greater than 50 weight percent non-cyclic isoparaffins. They have measurable quantities of unsaturated molecules measured by FIMS. Preferably they have greater than 10 weight percent molecules with cycloparaffinic functionality, more preferably greater than 20. They preferably have a ratio of weight percent molecules with monocycloparaffinic functionality to weight percent molecules with multicycloparaffinic functionality greater than 15, more preferably greater than 20, even more preferably greater than 30. The presence of predominantly cycloparaffinic molecules with monocycloparaffinic functionality in the lubricating base oil fractions provides excellent oxidation stability as well as desired additive solubility and elastomer compatibility. The lubricating base oil fractions have a weight percent olefins less than 10, preferably less than 5, more preferably less than 1, and most preferably less than 0.5. The lubricating base oil fractions preferably have a weight percent aromatics less than 0.3, more preferably less than 0.07, and most preferably less than 0.02.

The lubricating base oils useful in this invention are distinct from polyalphaolefins in that they are made from a waxy feed. Another distinction between polyalphaolefins and the lubricating base oils useful in this invention are that polyalphaolefins do not contain hydrocarbon molecules having consecutive numbers of carbon atoms. Polyalphaolefins are tri-, tetra- or penta- oligomers of 1-alkenes. Polyalphaolefins are small aliphatic molecules with branching of long alkyl chains at 2-, 4-, 6-, etc. positions, the positions depending upon the extent of oligomerization. Unlike polyalphaolefins, the lubricating base oils useful in our invention contain hydrocarbon molecules having consecutive numbers of carbon atoms.

Molecular Composition by FIMS:

The lubricating base oils made from a waxy feed of this invention were characterized by Field Ionization Mass Spectroscopy (FIMS) into alkanes and molecules with different numbers of unsaturations. The distribution of the molecules in the oil fractions was determined by FIMS. The samples were introduced via solid probe, preferably by placing a small amount (about 0.1 mg.) of the lubricating base oil to be tested in a glass capillary tube. The capillary tube was placed at the tip of a solids probe for a mass spectrometer, and the probe was heated from about 50° C. up to 600° C. at a rate of 100° C. per minute in a mass spectrometer operating at about 10-6 torr. The mass spectrometer was scanned from m/z 40 to m/z 1000 at a rate of 5 seconds per decade.

The mass spectrometer used was a Micromass Time-of-Flight. Response factors for all compound types were assumed to be 1.0, such that weight percent was determined from area percent. The acquired mass spectra were summed to generate one "averaged" spectrum.

The lubricating base oils of this invention were characterized by FIMS into alkanes and molecules with different numbers of unsaturations. The molecules with different numbers of unsaturations may be comprised of cycloparaffins, olefins, and aromatics. If aromatics were present in significant amounts in the lubricating base oil they would predominantly be identified in the FIMS analysis as 4-unsaturations. When olefins were present in significant amounts in the lubricating base oil they would be predominantly identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the wt % olefins by $^1$H NMR, and minus the wt % aromatics by HPLC-UV is the total weight percent of molecules with cycloparaffinic functionality in the lubricating base oils of this invention. Note that if the aromatics content was not measured, it was assumed to be less than 0.1 wt % and not included in the calculation for total weight percent of molecules with cycloparaffinic functionality.

Molecules with cycloparaffinic functionality mean any molecule that is, or contains as one or more substituents, a monocyclic or a fused multicyclic saturated hydrocarbon group. The cycloparaffinic group may be optionally substituted with one or more substituents. Representative examples include, but are not limited to, cyclopropyl, cyclobutyl, cyclopentyl, cyclohexyl, cycloheptyl, decahydronaphthalene, octahydropentalene, (pentadecan-6-yl)cyclohexane, 3,7,10-tricyclohexylpentadecane, decahydro-1-(pentadecan-6-yl)naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more substituents. Representative examples include, but are not limited to, cyclopropyl, cyclobutyl, cyclopentyl, cyclohexyl, cycloheptyl, (pentadecan-6-yl) cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group preferably is of two fused rings. The cycloparaffinic group may be optionally substituted with one or more substituents. Representative examples include, but are not limited to, decahydronaphthalene, octahydropentalene, 3,7,10-tricyclohexylpentadecane, decahydro-1-(pentadecan-6-yl) naphthalene, and the like.

Wt % Olefins:

The Wt % Olefins in the lubricating base oils of this invention were determined by proton-NMR by the following steps, A-D:

A. Prepare a solution of 5-10% of the test hydrocarbon in deuterochloroform.
B. Acquire a normal proton spectrum of at least 12 ppm spectral width and accurately reference the chemical shift (ppm) axis. The instrument must have sufficient gain range to acquire a signal without overloading the receiver/ADC. When a 30 degree pulse is applied, the instrument must have a minimum signal digitization dynamic range of 65,000. Preferably the dynamic range will be 260,000 or more.
C. Measure the integral intensities between:
   6.0-4.5 ppm (olefin)
   2.2-1.9 ppm (allylic)
   1.9-0.5 ppm (saturate)
D. Using the molecular weight of the test substance determined by ASTM D 2503, calculate:
   1. The average molecular formula of the saturated hydrocarbons
   2. The average molecular formula of the olefins
   3. The total integral intensity (=sum of all integral intensities)
   4. The integral intensity per sample hydrogen (=total integral/number of hydrogens in formula)
   5. The number of olefin hydrogens (=olefin integral/integral per hydrogen)
   6. The number of double bonds (=olefin hydrogen times hydrogens in olefin formula/2)
   7. The wt % olefins by $^1$H NMR=100 times the number of double bonds times the number of hydrogens in a typical olefin molecule divided by the number of hydrogens in a typical test substance molecule.

The wt % olefins by $^1$H NMR calculation procedure, D, works best when the % olefins result is low, less than about 15 weight percent. The olefins must be "conventional"

olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV:

The method used to measure low levels of molecules with at least one aromatic function in the lubricating base oils of this invention employed a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated lubricating base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the -electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricating base oils.

HPLC-UV Calibration:

HPLC-UV was used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in lubricating base oils exhibit a distinct peak absorbance at 272 nm that corresponds to the same (forbidden) transition that unsubstituted tetralin model compounds do at 268 nm. The concentration of alkyl-1-ring aromatic naphthenes in lubricating base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole lubricating base oil sample.

This calibration method was further improved by isolating the 1-ring aromatics directly from the lubricating base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricating base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricating base oils were single-ring aromatics.

High power, long duration, and good baseline analysis were needed to accurately measure aromatics down to 0.2% aromatic molecules. More specifically, to accurately measure low levels of all molecules with at least one aromatic function by NMR, the standard D 5292-99 method was modified to give a minimum carbon sensitivity of 500:1 (by ASTM standard practice E 386). A 15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

The medium-speed diesel engine oils of this invention may also comprise a bright stock in the formulation. If the bright stock is one with a viscosity index less than 120, it is preferably included in the formulation at a level less than 10 wt %. If the bright stock is one with a viscosity index greater than 120, such as bright stock derived from Daqing crude (which has a viscosity index of about 135), it may be included in the medium-speed diesel engine oil at a level up to 55 wt %. One preferred formulation of medium-speed diesel engine oil is one with a Fischer-Tropsch derived bright stock.

In one embodiment of this invention, the medium-speed diesel engine oils are made with a pour point reducing blend component. The pour point reducing blend component is a type of lubricating base oil made from a waxy feed. The pour point reducing blend component is an isomerized waxy product with relatively high molecular weights and particular branching properties such that it reduces the pour point of lubricating base oil blends containing them. The pour point depressing base oil blending component may be derived from either Fischer-Tropsch or petroleum products. In one embodiment the pour point reducing blend component is an isomerized petroleum derived base oil having a boiling range above about 950 degrees F. (about 510 degrees C.) and contains at least 50 percent by weight of paraffins. Preferably the pour point depressing base oil blending component will have a boiling range above about 1050 F. (about 565 degrees C.). In a second embodiment, the pour point reducing blend component is an isomerized Fischer-Tropsch derived bottoms product having a pour point that is at least 3 degrees C. higher than the pour point of the distillate base oil it is blended with. A preferred isomerized Fischer-Tropsch derived bottoms product that serves well as a pour point reducing blend component has an average molecular weight between about 600 and about 1100 and an average degree of branching in the molecules between about 6.5 and about 10 alkyl branches per 100 carbon atoms. The pour point reducing blend components are described in detail in U.S. patent applications Ser. No. 10/704031, filed Nov. 7, 2003, and Ser. No. 10/839396, filed May 4, 2004, both fully incorporated herein. The medium-speed diesel engine oils of this invention may contain between 1 and 80 wt % of a pour point reducing base oil blend component. Preferably, they will contain no conventional pour point depressant additives. Conventional pour point depressant additives work by minimizing the formation of wax networks and thereby reduce the amount of oil bound up in the network. Examples of conventional pour point depressant additives include polyalkylmethacrylates, styrene ester polymers, alkylated naphthalenes, ethylene vinyl acetate copolymers, and polyfumarates. Treat rates of conventional pour point depressant additives are typically less than 0.5 wt %.

Energy Savings:

In preferred embodiments, the medium-speed diesel engine oils of this invention will reduce energy use by at least 1% compared to medium-speed diesel engine oils of the same SAE viscosity grade made with a conventional Group I or Group II base oil. This is due to the low traction coefficients of certain base oils made from waxy feeds. The medium-speed diesel engine oils of this invention will reduce energy use when the lubricating base oil made from a waxy feed used in the medium-speed diesel engine oil has a traction coefficient less than an amount calculated by the equation: Traction Coefficient =0.009×Ln (Kinematic Viscosity in cSt)−0.001, wherein the Kinematic Viscosity during the traction coefficient measurement is between 2 and 50 cSt; and wherein the traction coefficient is measured at an average rolling speed of 3 meters per second, a slide to roll ratio of 40 percent, and a load of 20 Newtons. Additionally the base oil made from a waxy feed may have an EHD film thickness greater than an amount calculated by the equation: EHD film thickness in nanometers=(10.5×Kinematic Viscosity in cSt)+20, wherein the Kinematic Viscosity during the EHD film thickness measurement is between 2 and 50 cSt; measured at an entrainment speed of 3 meters per second, a slide to roll ratio of zero percent, and a load of 20 Newtons. Lubricating base oils made from a waxy feed having these low traction coefficients and relatively thick EHD film thicknesses are taught in U.S. patent application Ser. No. 10/835219, filed Apr. 29, 2004.

Traction data were obtained with an MTM Traction Measurement System from PCS Instruments, Ltd. The unit was configured with a polished 19 mm diameter ball (SAE AISI 52100 steel) angled at 22° to a flat 46 mm diameter polished disk (SAE AISI 52100 steel). Measurements were made at 40° C., 70° C., 100° C., and 120° C. The steel ball and disk were driven independently by two motors at an average rolling speed of 3 Meters/sec and a slide to roll ratio of 40% [defined as the difference in sliding speed between the ball and disk divided by the mean speed of the ball and disk. SRR=(Speed1−Speed2)/((Speed1+Speed2)/2)]. The load on the ball/disk was 20 Newton resulting in an estimated average contact stress of 0.546 GPa and a maximum contact stress of 0.819 GPa.

Each oil's traction coefficient data was plotted against its respective kinematic viscosity data at each test temperature (40° C., 70° C., 100° C., and 120° C.). That is, an oil's 40° C. kinematic viscosity [x coordinate] was paired with its 40° C. traction data [y coordinate], etc. Since kinematic viscosity information was generally only available at 40° C. and 100° C., the 70° C. and 120° C. kinematic viscosities were estimated from the 40° C. and 100° C. data using the well known Walther Equation [Log10(Log10(vis+0.6))=a-c*Log10(Temp, degs K)]. The Walther Equation is the most widely used equation for estimating viscosities at odd temperatures and forms the basis for the ASTM D341 viscosity-temperature charts. Results for each oil were reported on a linear fit of the log traction coefficient data versus kinematic viscosity in cSt. The traction coefficient result for each oil at 15 cSt kinematic viscosity, and other kinematic viscosities, were read off of the plots and tabulated.

Engine Oil Additive Package:

The medium-speed diesel engine oils of this invention are distinguished from passenger car and heavy duty diesel engine oils by using an additive package formulated to protect silver bearings. Zinc containing antiwear additives often used in passenger car and heavy duty diesel engine oils, in particular zinc dithiophosphate, may harm silver bearings. The engine oil additive packages useful in this invention contain a low amount of zinc, generally less than 250 ppm zinc, preferably less than 100 ppm zinc; and in preferred embodiments do not contain any zinc dithiophosphate.

Additive suppliers sell additive packages formulated to protect silver bearings. They often contain most of the components necessary to blend a medium-speed diesel engine oil. Typically the engine oil additive package is used in an amount between 5 and 20 wt % to blend to a specific TBN target. When blending a multigrade medium-speed diesel engine oil, a viscosity index improver in an amount between about 2.5 and 4% is usually added to increase the viscosity at 100° C. up to specification, while retaining good low temperature properties. Occasionally a conventional pour point depressant additive is also required. Examples of medium-speed diesel engine oil additive packages that are formulated to protect silver bearings and are useful in this invention are OLOA® 2000 and OLOA® 2939. OLOA® 2000 contains less than 30 ppm zinc and is designed to produce a 10 and 17 TBN railroad engine oil. OLOA® 2939 contains less than 50 ppm zinc and is designed to produce a 10 and 13 TBN railroad engine oil. OLOA® is a registered trademark of Chevron Oronite Company LLC. Typical additive packages that are formulated to protect silver bearings contain one or more of the following components (and mixtures of the components) as follows: Alkyl phenates, sulfonates, salicylates, and carboxylate detergents; succiminide, succinate esters, mannich and phosphorus dispersants; phenolic, amine, sulfides and sulfurized phenol antioxidants; organic acids, esters, fatty acids, sulfur compounds, phosphorus compounds, borate, and molybdenum antiwear compounds and/or friction modifiers.

EXAMPLES

Example 1

One distillate fraction (FT-6.4) and two distillate bottoms fractions (FT-14 and FT-16) of lubricating base oil made from the hydroisomerization of a Fischer-Tropsch derived waxy feed were produced in a pilot plant. The FIMS analysis was conducted on a Micromass Time-of-Flight spectrophotometer. The emitter on the Micromass Time-of-Flight was a Carbotec 5 um emitter designed for FI operation. A constant flow of pentaflourochlorobenzene, used as lock mass, was delivered into the mass spectrometer via a thin capillary tube. The probe was heated from about 50° C. up to 600® C. at a rate of 100° C. per minute. The properties of these lubricating base oils are summarized in Table I.

TABLE I

| Properties | FT-6.4 | FT-14 | FT-16 |
|---|---|---|---|
| Viscosity at 100° C., cSt | 6.362 | 13.99 | 16.48 |
| Viscosity Index | 153 | 157 | 149 |
| Wt % Aromatics | 0.05896 | 0.0414 | na |
| Wt % Olefins | 3.49 | 3.17 | 0.12 |
| FIMS, Wt % | | | |
| Alkanes | 68.1 | 59.0 | 61.5 |
| 1-Unsaturations | 31.2 | 40.2 | 38.1 |
| 2-Unsaturations | 0.7 | 0.8 | 0.4 |
| 3-Unsaturations | 0.0 | 0.0 | 0.0 |
| 4-Unsaturations | 0.0 | 0.0 | 0.0 |
| 5-Unsaturations | 0.0 | 0.0 | 0.0 |
| 6-Unsaturations | 0.0 | 0.0 | 0.0 |
| Total | 100.0 | 100.0 | 100.0 |
| Total Molecules with Cycloparaffinic Functionality | 28.4 | 37.8 | 38.4 |
| Monocycloparaffins/ Multicycloparaffins | 39.6 | 46.3 | 95.0 |
| Boiling Point Distribution, ° F. | | | na |
| T5 | 847 | 963 | |
| T10 | 856 | 972 | |
| T20 | 869 | 990 | |
| T30 | 881 | 1006 | |
| T50 | 905 | 1045 | |
| T70 | 931 | 1090 | |
| T80 | 946 | 1122 | |
| T90 | 962 | 1168 | |
| T95 | 972 | 1203 | |
| Pour Point, ° C. | −23 | −8 | −26 |
| Traction Coefficient | | Not tested | Not tested |
| Visc (cst)/Traction Coef. | 6.4/0.01138<br>12.5/0.01732<br>15/0.0197<br>32/0.02415 | | |

FT-6.4, FT-14, and FT-16 are all examples of the preferred lubricating base oils useful in the medium-speed diesel engine oils of this invention, that is, they have less than 0.3 wt % aromatics, greater than 10 wt % molecules with cycloparaffin functionality, and a ratio of molecules with monocycloparaffinic functionality to molecules with multicycloparaffinic functionality greater than 15. FT-6.4 has a viscosity index greater than an amount defined by 28×Ln (Kinematic Viscosity at 100° C.)+95. The viscosity index of FT-6.4=28×Ln(6.362)+101.19=153. FT-6.4 also has a very low traction coefficient. In addition, FT-14 and FT-16 are also compositions of pour point reducing base oil blend component and FT-16 is a Fischer-Tropsch derived bright stock.

Example 2

Three blends of railroad engine oil having a SAE 20W-40 viscosity grade and a 17 TBN were prepared by mixing either FT-6.4, or FT-6.4 and FT-14, with a commercial railroad engine oil additive package having less than 30 ppm zinc, OLOA® 2000. Two of the blends, RREO A and RREO B, also contained a bright stock derived from Daqing crude. Bright stock derived from Daqing crude is unlike the majority of commercially available bright stocks as it has a higher viscosity index, generally greater than 120, typically about 135. None of the three blends contained any viscosity index improver or conventional pour point depressant additive. The three railroad engine oils were tested for kinematic viscosity at 100° C., GE HTHS (final), cold cranking simulator viscosity at −15° C., and density at 60° F. The properties of the bright stock derived from Daqing crude used in the blends are summarized in Table II. The formulation compositions and test data are summarized in Table III.

TABLE II

| | Bright Stock Derived from Daqing Crude |
|---|---|
| Viscosity at 100° C., cSt | 21.45 |
| Viscosity Index | 137 |
| Pour Point, ° C. | −21 |
| T10 Boiling Point, ° F. | 989 |
| T90 Boiling Point, ° F. | 1253 |

TABLE III

| | RREO A | RREO B | RREO C |
|---|---|---|---|
| OLOA ® 2000, wt % | 15.74 | 15.74 | 15.74 |
| VII-OLOA ® 167, wt % | 0 | 0 | 0 |

TABLE III-continued

| | | RREO A | RREO B | RREO C |
|---|---|---|---|---|
| PPD, wt % | | 0 | 0 | 0 |
| FT-6.4, wt % | | 35.35 | 36.84 | 12.64 |
| FT-14, wt % | | 0 | 0 | 71.62 |
| Bright Stock Derived from Daqing Crude, wt % | | 48.91 | 47.42 | 0 |
| Vis @ 100° C. | 12.6-16.3 | 15.60 | 15.28 | 15.22 |
| GE HTHS, cP (initial) | | 12.4 | na | na |
| GE HTHS, cP (final) | 10.8 min | 11.8 | na | na |
| CCS, −15° C. cP (9500 max for 20W) | | 4784 | 4436 | 4240 |

na = not available

Example 3

A blend of railroad engine oil having a SAE 20W-40 viscosity grade and a 17 TBN is prepared by mixing FT-6.4 and FT-16, with the same commercial railroad engine oil additive package used in the earlier examples. The blend contains no viscosity index improver or conventional pour point depressant additive. The railroad engine oil is tested for kinematic viscosity at 100° C., GE HTHS (final), and cold cranking simulator viscosity at −15° C. The formulation composition and test data is summarized in Table IV.

TABLE IV

| | | RREO D |
|---|---|---|
| OLOA ® 2000, wt % | | 15.74 |
| VII-OLOA ® 167, wt % | | 0 |
| PPD, wt % | | 0 |
| FT-6.4, wt % | | 13.78 |
| FT-16, wt % | | 70.48 |
| Vis @ 100° C. | 12.6-16.3 | 15.3 |
| GE HTHS (final), cP | 10.8 min | >10.8 |
| CCS, −15° C. cP (9500 max for 20W) | | <4200 |

na = not available

This example of railroad engine oil has an even higher VI and lower CCS viscosity than the three earlier examples. This is due to the combination of two different desirable lubricating base oils, one of which is a Fischer-Tropsch derived bright stock with a viscosity index greater than 120 (FT-16).

Example 4

Seven different comparison blends of railroad engine oil were made with commercially available conventional Group I or Group II base oils. These oils are representative of the medium-speed diesel engine oils that were available prior to this invention. All of these seven railroad engine oils were blended to obtain a SAE 40 or SAE 20W-40 viscosity grade, and 17 TBN. The SAE 20W-40 blends contained between one and three different lubricating base oils, greater than 2 wt % viscosity index improver, and no conventional pour point depressant additive. In these blends the viscosity index improver was needed to help provide the desired low cold cranking simulator viscosity to provide the winter "W" grade performance. The formulation compositions and test data are summarized in Table V.

TABLE V

| Target SAE Grade | LIMITS | Comparison RREO 1 20W40 | Comparison RREO 2 20W40 | Comparison RREO 3 20W40 | Comparison RREO 4 20W40 | Comparison RREO 5 20W40 | Comparison RREO 6 20W40 | Comparison RREO 7 40 |
|---|---|---|---|---|---|---|---|---|
| OLOA ® 2000, wt % | | 15.74 | 15.74 | 15.74 | 15.74 | 15.74 | 15.74 | 15.74 |
| VII - OLOA ® 167, wt % | | 3.46 | 3.54 | 3.65 | 2.45 | 3.59 | 2.03 | 0 |
| PPD wt % | | 0 | 0 | 0 | 0 | 0 | 0 | 0 |
| First Base Oil wt % | | Chevron Neutral Oil 220R 29.8 | Chevron Neutral Oil 220R 30.0 | Exxon 150LP 23.21 | Exxon 150LP 19.0 | Exxon 300SN 64.9 | Exxon 150LP 24.5 | Exxon 600SN 84.26 |
| Second Base Oil wt % | | Chevron Neutral Oil 600R 36.0 | Chevron Neutral Oil 600R 33.2 | Exxon 600SN 57.4 | Exxon 600SN 63.0 | Exxon 600SN 15.8 | Exxon 600SN 57.7 | none |
| Third Base Oil wt % | Conventional B/S 10% Max | Witco 2033-100 15.0 | RAFFENE ® 750L 18.0 | None | none | None | none | none |
| Total | | 100.0 | 100.0 | 100.0 | 100.0 | 100.0 | 100.0 | 100.0 |
| Viscosity at 100° C. | 12.6-16.3 | 15.2 | 15.35 | 15.44 | 15.3 | 15.3 | 15.35 | 15.77 |
| GE HTHS (final), cP | 10.8 min | 11.1 | 11.1 | 11 | 11.9 | 11.0 | 11.3 | 13.4 |
| CCS, −10° C. cP | (4500 max for 20W) | 4195 | 4570 | 4290 | 4440 | 4285 | 4213 | na |
| CCS, −15° C. cP | (9500 max for 20W) | 7545 | 8210 | na | 8670 | Na | na | 16669 |

na = not available

RAFFENE ® is a registered trademark of San Joaquin Refining Company, Inc.

Although a number of these blends met the requirements for SAE 20W-40 engine oil, none of them, even with the addition of OCP viscosity index improver (OLOA 167), had the desired low cold cranking simulator viscosity of the medium-speed diesel engine oils of this invention.

We claim:

1. A lubricating oil, comprising:

a. a lubricating base oil, made from a waxy feed;

b. an engine oil additive package formulated to protect silver bearings; and c. less than 2.0 wt % viscosity index improver;

i. wherein the lubricating oil has a cold cranking simulator viscosity at −15° C. less than 7000 cP, a GE HTHS (final) of at least 10.8 cP, and a TBN between 8 and 20.

2. The lubricating oil of claim 1, wherein the lubricating base oil, made from a waxy feed, has:

a. less than 0.3 wt % aromatics;

b. greater than 10 wt % molecules with cycloparaffinic functionality;

c. a ratio of molecules with monocycloparaffinic functionality to molecules with multicycloparaffinic functionality greater than 15.

3. The lubricating oil of claim 1, wherein the TBN is between 10 and 20.

4. The lubricating oil of claim 2, wherein the lubricating base oil has less than 0.07 wt % aromatics.

5. The lubricating oil of claim 1, wherein the lubricating base oil has a viscosity index greater than 28×Ln(Kinematic Viscosity at 1000° C.) +95.

6. The lubricating oil of claim 1, additionally comprising a bright stock having a viscosity index greater than 120.

7. The lubricating oil of claim 1, comprising no viscosity index improver.

8. The lubricating oil of claim 1, wherein the lubricating oil does not contain zinc dithiophosphate.

9. The lubricating oil of claim 1, wherein the lubricating oil is a SAE 15W-XX, SAE 20W-XX, or SAE 25W-XX, where XX is selected from the group consisting of 40, 50, and 60.

10. The lubricating oil of claim 1, wherein the lubricating oil has a cold cranking simulator viscosity at −15° C. less than 5000 cP.

11. The lubricating oil of claim 1, additionally comprising a pour point reducing base oil blend component.

12. The lubricating oil of claim 11, wherein the pour point reducing base oil blend component is selected from the group of: a) an isomerized Fischer-Tropsch derived bottoms product having an average molecular weight between about 600 and about 1100 and an average degree of branching in the molecules between about 6.5 and about 10 alkyl branches per 100 carbons, b) an isomerized petroleum derived base oil having a boiling range above about 510 degrees C. (about 950 degrees F.) and containing at least 50 percent by weight of paraffins, and c) mixtures thereof.

13. The lubricating oil of claim 12, additionally comprising no conventional pour point depressant additives selected from the group consisting of polyalkylmethacrylates, styrene ester polymers, alkylated naphthalenes, ethylene vinyl acetate copolymers, and polyfumarates.

14. The lubricating oil of claim 1, wherein the lubricating oil additionally meets the specifications for Electro Motive Division or General Electric.

15. The lubricating oil of claim 1, wherein the waxy feed is Fischer-Tropsch derived.

16. The lubricating oil of claim 1, wherein the engine oil additive package has less than 250 ppm zinc.

17. The lubricating oil of claim 16, wherein the engine oil additive package has less than 100 ppm zinc.

18. The lubricating oil of claim 16, wherein the engine oil additive package contains one or more of the following components: alkyl phenate, sulfonate, salicylate, and carboxylate detergent; succinimide, succinate esters, mannich and phosphorus dispersant; phenolic, amine sulfide and sulfurized phenol antioxidant; organic acids, esters, fatty acids, sulfur compound, phosphorus compound, borate, and molybdenum antiwear compound and/or friction modifier.

19. The lubricating oil of claim 1, wherein the engine oil additive package is OLOA® 2000 or OLOA® 2939.

20. The lubricating oil of claim 1, wherein the lubricating oil has no additional conventional pour point depressant additive.

21. The lubricating oil of claim 20, wherein the conventional pour point depressant additive is selected from the group consisting of polyalkylmethacrylates, styrene ester polymers, alkylated naphthalenes, ethylene vinyl acetate copolymers, and polyfumarates.

22. A lubricating oil, comprising:

a. between 5 and 88 wt % lubricating base oil made from a waxy feed;

b. between 5 and 20 wt % engine oil additive package formulated to protect silver bearings;

c. between less than 10 wt % and 55 wt %, and not including 0 wt %, bright stock having a viscosity index greater than 120; and d. no viscosity index improver or conventional pour point depressant additives;

i. wherein the lubricating oil has a cold cranking simulator viscosity at −15° C. less than 7000 cP.

23. The lubricating oil of claim 22, wherein the cold cranking simulator viscosity at −15° C. is less than 5000 cP.

24. The lubricating oil of claim 22, comprising: from 10 wt % to up to 55 wt % bright stock having a viscosity index greater than 120.

* * * * *